US006452501B1

(12) United States Patent
Tse et al.

(10) Patent No.: US 6,452,501 B1
(45) Date of Patent: Sep. 17, 2002

(54) AUTOMATIC SHUT-OFF AND INDICATION DEVICE FOR AN ELECTRIC HEATING APPLIANCE AND ELECTRIC PRESSING IRON COMPRISING SUCH A DEVICE

(75) Inventors: Hong W. C. Tse; Kok K. Yap; Bernardus F. R. I. Wilkens, all of Singapore (SG)

(73) Assignee: Koninklijke Philips Electronics, N.V., Eindhoven (NL)

( * ) Notice: Subject to any disclaimer, the term of this patent is extended or adjusted under 35 U.S.C. 154(b) by 1013 days.

(21) Appl. No.: 08/637,838

(22) Filed: Apr. 25, 1996

(30) Foreign Application Priority Data

Apr. 25, 1995 (SG) ..... 9500326-5

(51) Int. Cl.[7] ..... G08B 21/00

(52) U.S. Cl. ..... 340/640; 340/641; 340/635; 200/61.45 R; 200/61.52; 200/61.58 R; 219/227; 219/248; 219/251; 219/507; 219/509; 361/179

(58) Field of Search ..... 340/640, 635, 340/641, 644, 655; 200/61.45 R, 61.52, 61.58 R, 61.85; 219/250, 227, 240, 248, 251, 507, 509, 243; 361/179

(56) References Cited

U.S. PATENT DOCUMENTS 4,203,101 A 5/1980 Townsend ..... 340/635
4,661,685 A * 4/1987 Contri ..... 219/250
4,692,589 A * 9/1987 Borsari et al. ..... 219/251

* cited by examiner

*Primary Examiner*—Julie Lieu
(74) *Attorney, Agent, or Firm*—Ernestine C. Bartlett

(57) ABSTRACT

An automatic shut-off and indication device for an electric heating appliance is provided which includes:

a sensor (2) for sensing usage of the appliance and for providing a usage-signal (US) indicating a non-usage of the appliance;

a switch (10) for off-switching a heater (12) of the appliance in response to a switching signal (SS) derived from the usage-signal (US);

a sensor (4) for sensing orientation of the appliance and for providing an orientation signal (OS) for indicating different orientations of the appliance;

a selector (18) for activating an indicator (22) in response to the switching signal (SS), the indicator (22) signaling the off-switching of the heater (12); and an indication timer (8) for providing a time delay between off-switching the heater (12) and activating the indicator (22), which time delay is dependent on the orientation signal (OS).

The shut-off of the heater (12) is signalled to the user by the indicator (22). A different time-delay between shut-off and indication depending on the orientation of the appliance provides the possibility to postpone the indication when the appliance is shut off in a regular rest position, for instance the heel rest position of an electric pressing iron.

25 Claims, 4 Drawing Sheets

AUTOMATIC SHUT-OFF AND INDICATION DEVICE FOR AN ELECTRIC HEATING APPLIANCE AND ELECTRIC PRESSING IRON COMPRISING SUCH A DEVICE

FIELD OF THE INVENTION

The invention relates to an automatic shut-off and indication device for an electric heating appliance comprising: means for sensing usage of the appliance and for providing a usage-signal indicating a non-usage of the appliance; means for off-switching a heater of the appliance in response to a switching signal derived from the usage-signal; means for sensing orientation of the appliance and for providing an orientation signal for indicating different orientations of the appliance; and means for activating an indicator in response to the switching signal, the indicator signalling the off-switching of the heater.

The invention further relates to an electric pressing iron comprising such a device.

BACKGROUND OF THE INVENTION

Such a device and iron are known, for instance, from U.S. Pat. No. 4,203,101. Automatic shut-off (ASO) systems for electric heating appliances, particularly for electric pressing irons are known. A sensor, for example a motion sensor with a mercury switch or a hand sensor monitors whether the pressing iron is being used or not. The ASO system switches off the electrical heater of the iron when the iron is not used for a certain period in order to avoid a hazardous situation when the iron is left unattended. The indicator warns the user that the heating element is switched off. The indicator can be a visual one, for example a lamp or an audible one, for example a buzzer. When the user starts again using the iron, the ASO system switches on the heater of the iron. Usually, pressing irons can be left unattended in a substantial horizontal position or in a substantial vertical or heel rest position. Especially in the vertical position the indication can be irritating to the user if the time-out period is rather short, e.g. 30 seconds.

SUMMARY OF THE INVENTION

It is an object of the present invention to provide an improved ASO system for electric heating appliances. According to the invention the automatic shut-off and indication device as specified in the opening paragraph is characterized by means for providing a time delay between off-switching the heater and activating the indicator, which time delay is dependent on the orientation signal.

By providing a separate time delay for the activation of the indicator which is dependent on the orientation of the appliance it is achieved that the heater is always switched off at a moment which provides maximum safety, while the indicator is activated at an instant after switching off only when it makes sense to remind the user that the appliance is still connected to the mains. Particularly for pressing irons it is very convenient to provide that the time delay is shorter when the orientation signal indicates a substantial horizontal orientation of the appliance than the time delay in case the orientation signal indicates a substantial vertical position of the appliance. The time delay in the horizontal orientation may be zero to inform the user immediately of a very unsafe situation. The time delay in the vertical position can be much longer to accommodate for the usual intervals in the heel rest position during the ironing when the user would be irritated by the repeated operation of the indicator.

The means for sensing usage may comprise a motion sensor in a suitable place inside the appliance or a hand sensor in the handgrip of the appliance. In a preferred embodiment of the automatic shut-off and indication device, the means for providing a time delay comprises an indication timer for providing a delayed activation signal in response to the usage-signal and in the means for activating the indicator comprises: means for receiving the switching signal, the delayed activation signal and the orientation signal; and means for selecting one signal out of the switching signal and the delayed activation signal in response to predetermined values of the orientation signal. In this embodiment a selection is made between an immediate indication and a delayed indication depending on the orientation of the appliance after switch-off of the heater.

The heater may be switched off either immediately after the occurrence of the non-usage signal or after a certain delay provided by a switch-off timer which delays the response of the switching signal to the non-usage signal, for example for 30 seconds. In this way a time-out is created between the instant of detecting non-usage and the instant of switch-off of the heater. After off-switching of the heater, the indicator is activated after the lapse of a time period which depends on the orientation of the appliance. In case of a pressing iron this time period can be, for instance, zero seconds in the horizontal position and several minutes in the vertical position. This means that, when the heater is shut off after a certain time-out, the indicator is activated immediately in the horizontal position and activated delayed in the vertical position.

The automatic shut-off and indication device is particularly useful in electric pressing irons, but implementation in other electric heating appliances, such as water cookers, kettles, hair dryers and other hand-held or stationary heating appliances is possible as well.

BRIEF DESCRIPTION OF THE PREFERRED EMBODIMENTS

The above and other features and advantages of the invention will be apparent from the following description of exemplary embodiments of the invention with reference to the accompanying drawings, in which.

Throughout the drawings, similar reference signs denote similar parts.

Figure 1:
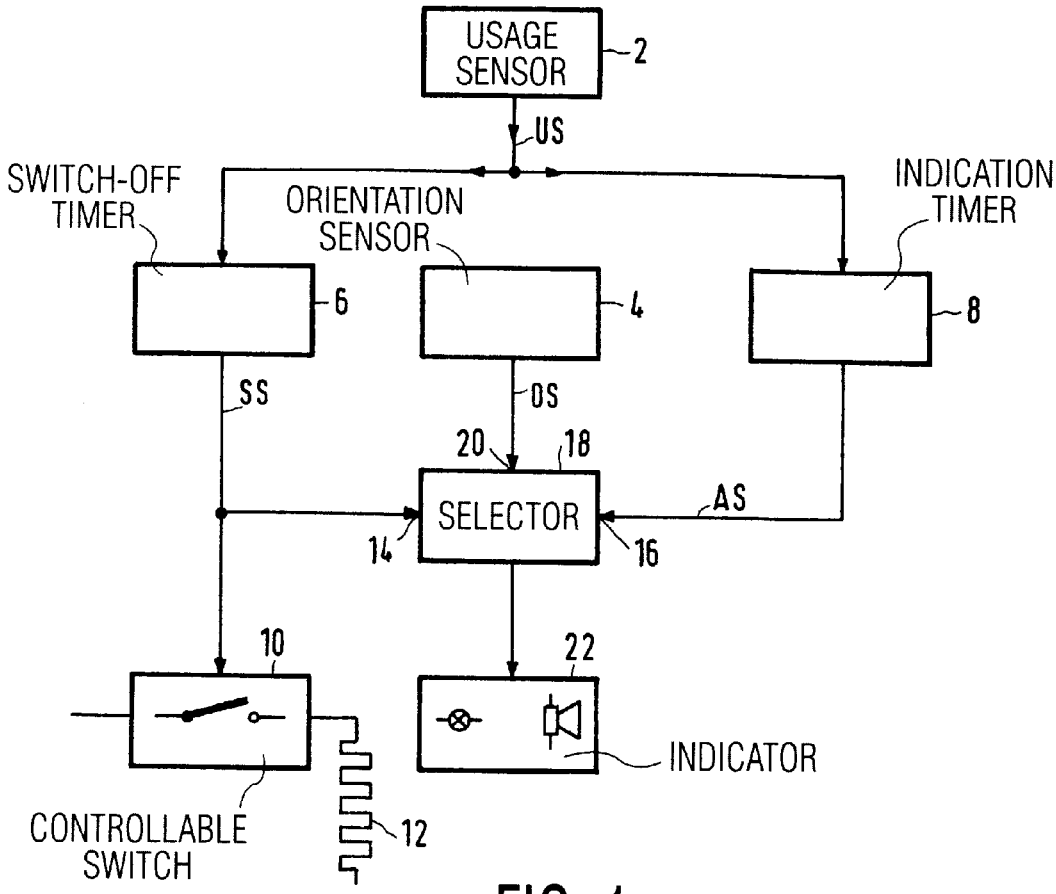
FIG. 1 is a block diagram of an automatic shut-off and indication device according to the invention.

FIG. 1 shows a block diagram of the automatic shut-off (ASO) and indication device according to the invention. Only by way of example the device is explained in relation to an electric pressing iron. A usage-sensor 2 detects whether the iron is being used or not and provides a usage-signal US which indicates usage or non-usage. An orientation sensor provides an orientation signal OS which indicates whether the iron is in the horizontal position or in the vertical position. The vertical position is also called heel rest position, because in that position the iron is placed during intervals when the iron is temporarily not being used. The usage-signal US triggers a switch-off timer 6 and an indication timer 8 when the usage-signal has a value which corresponds to the non-usage state of the iron. The switch-off timer 6 generates a delayed switching signal SS which drives a controllable switch 10. Switch 10 enables or disables electric current to flow through the electric heater element 12 of the iron. Indication timer 8 generates a delayed activation signal AS. The switching signal SS and the activation signal AS are fed to respective inputs 14 and 16 of a selector 18 which selects one of the signals SS and AS depending on the value of the orientation signal OS which is coupled to a select-input 20. The selected signal drives an indicator 22, which can be a visual indicator, for example a lamp, LED or LCD, or an acoustic indicator, for instance a loudspeaker or a buzzer.

Figure 2:
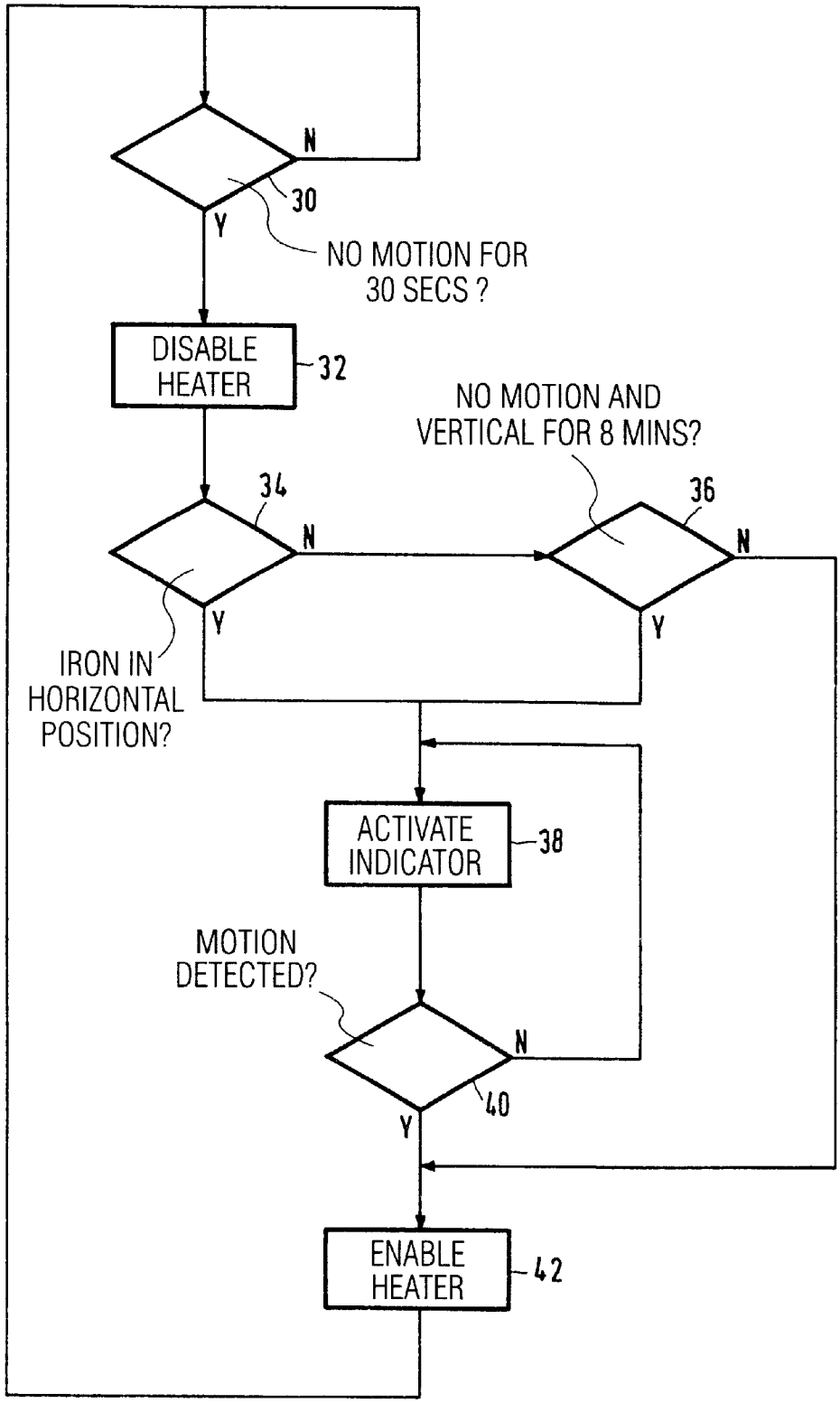
FIG. 2 is a flow chart explaining the functioning of an automatic shut-off and indication device according to the invention.

FIG. 2 shows a flow chart of the operation of the device of FIG. 1. The inscriptions to FIG. 2 are listed in the Table below.

TABLE

| Block | Inscription |
|---|---|
| 30 | no motion for 30 seconds? |
| 32 | disable heater |
| 34 | iron in horizontal position? |
| 36 | no motion and vertical for 8 minutes? |
| 38 | activate indicator |
| 40 | motion detected? |
| 42 | enable heater |

In the flow chart it is assumed that the usage-sensor 2 is a motion detector. However a hand sensor, touch sensor or approximation sensor can be employed as well for the same purpose. The usage-signal US continuously retriggers the timers 6 and 8 unless the usage-signal US maintains a steady state for the time-out period of the timers 6 and 8. If this steady state continues for 30 seconds, for example, the switch-off timer 6 opens the controllable switch 10 and no current can flow to the heater 12 (blocks 30, 32 ). If the position is horizontal (block 34 ) the indicator 22 is activated immediately (block 38 ). If the iron is in the vertical position and not moved for 8 minutes, for example, the delayed activation signal from indication timer 8 is selected in selector 18 and the indicator will be activated after 8 minutes (block 34, 36, 38 ). However, if the iron is moved in the vertical position the heater 12 is switched on anyhow (block 36, 42 ). As long as no motion is detected, indicator 22 is kept activated (block 38, 40 ), otherwise (block 42 ) the heater 12 is switched on.

It may be appreciated that the ASO and indication device shown in FIG. 1 and functioning as described in relation to the flow chart shown in FIG. 2 can be seen as a automatic shut-off system having a single time-out for off-switching the heater and a dual time-out for activating the indicator. The time-out periods of the timers 6 and 8 may of course have any suitable length, but in the given example the time-out period for indication timer 8 is preferably longer than that of the switch-off timer 6.

Figure 3:
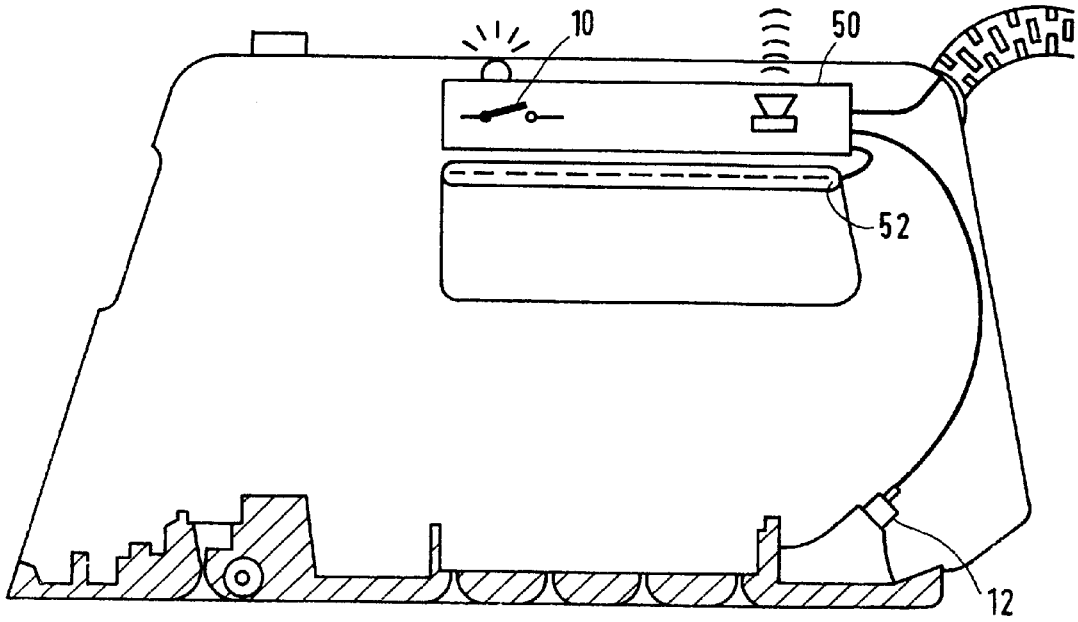
FIG. 3 shows a pressing iron with an automatic shut-off and indication device according to the invention.
Figure 4:
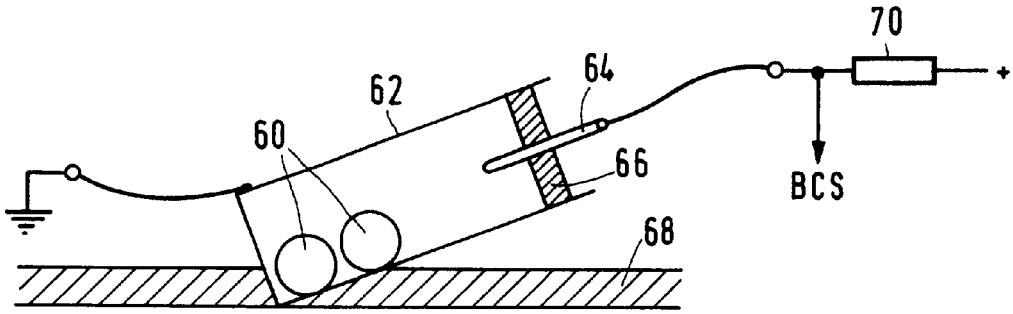
FIG. 4 shows a motion and orientation sensor for use in an automatic shut-off and indication device according to the invention.
Figure 5:
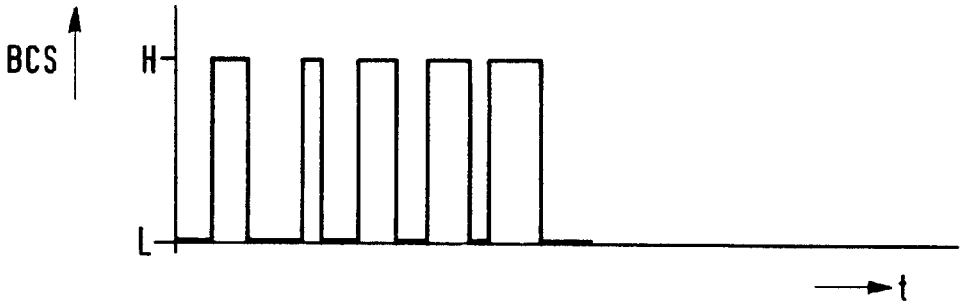
FIG. 5 shows a waveform of a signal generated by the sensor of FIG. 4 during motion.
Figure 6:
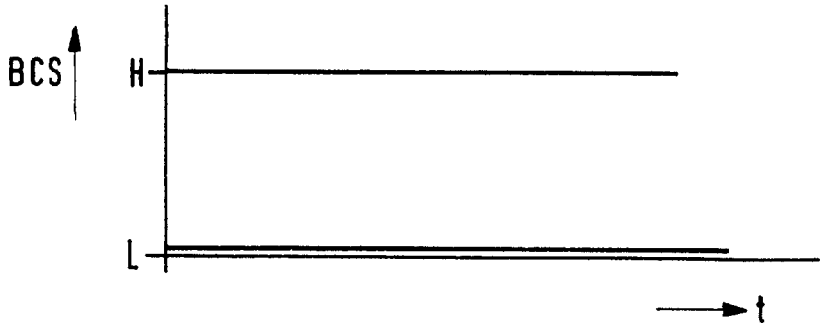
FIG. 6 shows waveforms of a signal generated by the sensor of FIG. 4 during steady state in different orientations.

FIG. 3 shows a pressing iron with the ASO and indication device according to the invention. The functional circuit blocks shown in FIG. 1 are incorporated in a unit 50 which is located in a suitable place inside the iron. The controllable switch 10, a buzzer and/or LED are shown by way of example. As already indicated, the usage-sensor 2 of FIG. 1 can be a hand sensor in the hand grip of the iron. In FIG. 3 a capacitive sensor 52 is shown which forms part of a sensor circuit which is known per se. However, the usage sensor 2 and the orientation sensor 4 of FIG. 1 can be advantageously combined in a ball contact switch shown in FIG. 4. This switch operates similar as a mercury switch. Instead of mercury metal balls 60 are used. The balls are enclosed in a metal can in which a metal electrode 64 protrudes through a non-conductive cap or lid 66. The ball contact switch can be mounted on a printed circuit board 68 in the unit 50 shown in FIG. 3, but any other position inside the iron can be chosen as desired. When the iron is moving the metal balls 60 roll towards the electrode 64 and back again to the shown position in the metal can 62. The result is an interrupting electrical contact between the can 62 and the electrode 64. By connecting the switch in series with a resistor 70 across a suitable supply voltage a ball contact signal BCS is available. During movement of the iron the signal BCS alternates between a low voltage value L and a high voltage value H as shown in FIG. 5. When the iron is not moved and in horizontal position, the balls 60 do not make contact with the electrode 64 and the signal BCS is permanently at high level H as shown in FIG. 6. When the iron is not moved and in vertical (heel rest) position, the balls 60 make contact with the electrode 64 and the signal BCS is permanently at low level L as also shown in FIG. 6. During movement of the iron the timers 6 and 8 are constantly retriggered by the alternating signal BCS and their respective time-out periods will not be reached.

Figure 7:
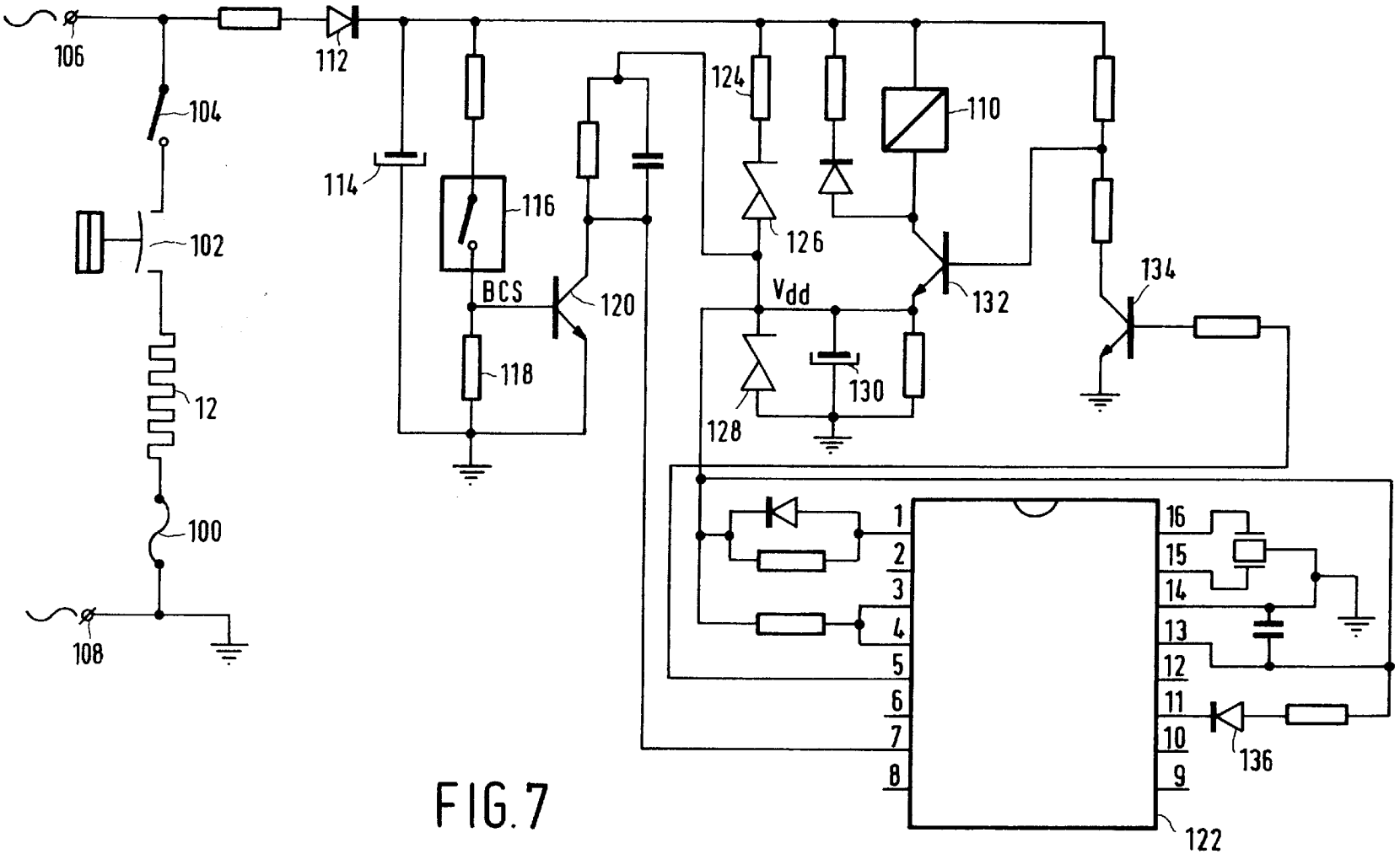
FIG. 7 shows an electric circuit diagram of a pressing iron with an automatic shut-off and indication device according to the invention.

The functional circuit blocks of FIG. 1 can be designed using conventional electronic circuitry. FIG. 7 shows an example circuit of an iron with the ASO and indication device according to the invention in which a microcontroller is employed for performing the control and timing functions in response to a ball contact switch. The heater 12 is connected in series with a thermal fuse 100, a thermostat 102 and a switch 104 between the mains power supply terminals 106 and 108. Switch 104 is driven by a solenoid 110 and is normally closed to enable mains current to flow through the heater 12. The temperature of the heater 12 is controlled by the thermostat 102. Switch 104 corresponds to the controllable switch 10 in the block diagram of FIG. 1. The mains voltage is rectified and smoothed with diode 112 and capacitor 114. A motion/orientation sensor 116 of the kind as shown in FIG. 4 is connected in series with a resistor 118 between the rectified mains voltage and ground. The voltage BCS across resistor 118 is buffered by NPN transistor 120 and fed to an input pin 7 of a microcontroller 122. Resistor 124, zener diodes 126 and 128 and capacitor 130 are connected in series across the rectified mains voltage to provide a low DC working voltage $V_{dd}$, amongst others to the microcontroller 122. The solenoid 110 is driven by a NPN transistor 132 via an interface transistor 134 from an output pin 5 of the microcontroller 122. The light emitting diode (LED) 136 connected to output pin 11 of the microcontroller 122 corresponds to the indicator 22 in FIG. 1. The microcontroller 122, is programmed to perform control according to the flow chart of FIG. 2. In this example circuit a commercially available microcontroller Motorola MC68HC05K0 is used, but any other suitable controller can be used as well. The remaining pins of the controller 122 are either not used, or used for functions not shown, or connected as commonly known or as recommended by the manufacturer of the controller.

What is claimed is:

1. An automatic shut-off and indication device for an electric heating appliance comprising:

means (2) for sensing usage of the appliance and for providing a usage signal (US) indicating a non-usage of the appliance;

means (10) for off-switching a heater (12) of the appliance in response to a switching signal (SS) derived from the usage-signal (US);

means (4) for sensing orientation of the appliance and for providing an orientation signal (OS) for indicating different orientations of the appliance;

means (18) for activating an indicator (22) in response to the switching signal (SS), the indicator (22) signaling the off-switching of the heater (12), the automatic shut-off and indication device including means (8) for providing a time delay between off-switching the heater (12) and activating the indicator (22), which time delay is dependent on the orientation signal (OS).

2. A device as claimed in claim 1, wherein the time delay is shorter in case the orientation signal (OS) indicates a substantial horizontal orientation of the appliance than the time delay in case the orientation signal (OS) indicates a substantial vertical position of the appliance.

3. A device as claimed in claim 1, wherein the means (2) for sensing usage comprises a motion sensor (60,62,64).

4. A device as claimed in claim 1, wherein the means (2) for sensing usage comprises a hand sensor (52) in a handgrip of the appliance.

5. A device as claimed in claim 1, wherein the means for providing a time delay comprises an indication timer (8) for providing a delayed activation signal (AS) in response to the usage-signal (US) and wherein the means (18) for activating the indicator comprises: means (14, 16, 20) for receiving the switching signal (SS), the delayed activation signal (AS) and the orientation signal (OS); and means for selecting one signal out of the switching signal (SS) and the delayed activation signal (AS) in response to predetermined values of the orientation signal (OS).

6. A device as claimed in claim 1, comprising a switch-off timer (6) for providing the switching signal (SS) in a delayed response to the usage-signal (US).

7. A device as claimed in claim 6, wherein the indication timer (8) provides a delay-time which is longer than the delay-time of the switch-off timer (6).

8. A device as claimed in claim 1, wherein the means for sensing usage (2) and the means for sensing orientation (4) comprise an electrically conductive can (62), an insulated electrode (64) protruding into the can (62) and at least one electrically conductive particle (60) moveable inside the can (62) for making electrical contact between the can (62) and the electrode (64).

9. An electric pressing iron comprising an electric heater (12) and an automatic shut-off and indication device (52) for shutting off the heater (12), the automatic shut-off and indication device comprising:

means (2, 52, 116) for sensing usage of the pressing iron and for providing a usage-signal indicating a non-usage of the pressing iron;

means (10, 104) for off-switching the heater (12) in response to a switching signal derived from the usage-signal;

means (4, 116) for sensing orientation of the pressing iron and for providing an orientation signal for indicating different orientations of the pressing iron;

means (18, 122) for activating an indicator (22, 136) in response to the switching signal, the indicator (22, 136) in response to the switching signal, the indicator (22, 136) signaling the off-switching of the heater (12), the automatic shut-off and indication device including means (8, 122) for providing a time delay between off-switching the heater (12) and activating the indicator (22, 136), which time delay is dependent on the orientation signal.

10. An iron as claimed in claim 9, wherein the means (8, 122) for providing a time delay comprises a indication timer (8, 122) for providing a delayed activation signal in response to the usage-signal and wherein the means (18, 122) for activating the indicator (22, 136) comprises: means (14, 16, 20; 122) for receiving the switching signal, the delayed activation signal and the orientation signal; and means (122) for selecting one signal out of the switching signal and the delayed activation signal in response to predetermined values of the orientation signal.

11. An iron as claimed in claim 9, comprising a switch-off timer (6, 122) for providing the switching signal in a delayed response to the usage-signal.

12. An iron as claimed in claim 11, wherein the indication timer provides a delay-time which is longer than the delay-time of the switch-off timer.

13. A device as claimed in claim 2, wherein the means (2) for sensing usage comprises a motion sensor (60,62,64).

14. A device as claimed in claim 2, wherein the means (2) for sensing usage comprises a hand sensor (52) in a handgrip of the appliance.

15. A device as claimed in claim 2, wherein the means for providing a time delay comprises an indication timer (8) for providing a delayed activation signal (AS) in response to the usage-signal (US) and in that the means (18) for activating the indicator comprises: means (14, 16, 20) for receiving the switching signal (SS), the delayed activation signal (AS) and the orientation signal (OS); and means for selecting one signal out of the switching signal (SS) and the delayed activation signal (AS) in response to predetermined values of the orientation signal (OS).

16. A device as claimed in claim 3, wherein the means for providing a time delay comprises an indication timer (8) for providing a delayed activation signal (AS) in response to the usage-signal (US) and in that the means (18) for activating the indicator comprises: means (14, 16, 20) for receiving the switching signal (SS), the delayed activation signal (AS) and the orientation signal (OS); and means for selecting one signal out of the switching signal (SS) and the delayed activation signal (AS) in response to predetermined values of the orientation signal (OS).

17. A device as claimed in claim 4, wherein the means for providing a time delay comprises an indication timer (8) for providing a delayed activation signal (AS) in response to the usage-signal (US) and in that the means (18) for activating the indicator comprises: means (14, 16, 20) for receiving the switching signal (SS), the delayed activation signal (AS) and the orientation signal (OS); and means for selecting one signal out of the switching signal (SS) and the delayed activation signal (AS) in response to predetermined values of the orientation signal (OS).

18. A device as claimed in claim 2, comprising a switch-off timer (6) for providing the switching signal (SS) in a delayed response to the usage-signal (US).

19. A device as claimed in claim 3, comprising a switch-off timer (6) for providing the switching signal (SS) in a delayed response to the usage-signal (US).

20. A device as claimed in claim 4, comprising a switch-off timer (6) for providing the switching signal (SS) in a delayed response to the usage-signal (US).

21. A device as claimed in claim 5, comprising a switch-off timer (6) for providing the switching signal (SS) in a delayed response to the usage-signal (US).

22. An iron as claimed in claim 10, comprising a switch-off timer (6, 122) for providing the switching signal in a delayed response to the usage-signal.

23. An iron as claimed in claim 9, wherein the time delay is shorter in case the orientation signal (OS) indicates a substantial horizontal orientation of the appliance than the time delay in case the orientation signal (OS) indicates a substantial vertical position of the appliance.

24. An iron as claimed in claim 9, wherein the means (2) for sensing usage comprises a motion sensor (60,62,64).

25. An iron as claimed in claim 9, wherein the means (2) for sensing usage comprises a hand sensor (52) in a handgrip of the appliance.

* * * * *